US008557175B2

(12) United States Patent
Masson

(10) Patent No.: US 8,557,175 B2
(45) Date of Patent: Oct. 15, 2013

(54) METHOD FOR MAKING PARTS WITH AN INSERT MADE OF A METAL-MATRIX COMPOSITE MATERIAL

(75) Inventor: Richard Masson, Buc (FR)

(73) Assignee: Messier-Bugatti-Dowty, Velizy-Villacoublay (FR)

( * ) Notice: Subject to any disclaimer, the term of this patent is extended or adjusted under 35 U.S.C. 154(b) by 574 days.

(21) Appl. No.: 12/810,874

(22) PCT Filed: Dec. 24, 2008

(86) PCT No.: PCT/EP2008/068292

§ 371 (c)(1),
(2), (4) Date: Oct. 11, 2010

(87) PCT Pub. No.: WO2009/083571

PCT Pub. Date: Jul. 9, 2009

(65) Prior Publication Data

US 2011/0027119 A1 Feb. 3, 2011

(30) Foreign Application Priority Data

Dec. 28, 2007 (FR) ..... 07 09173

(51) Int. Cl.
*B22F 7/04* (2006.01)

(52) U.S. Cl.
USPC ..... 419/5; 419/4; 419/8; 419/24; 419/49

(58) Field of Classification Search
USPC ..... 419/4, 5, 8, 24, 49
See application file for complete search history.

(56) References Cited

U.S. PATENT DOCUMENTS

| | | | | |
|---|---|---|---|---|
| 5,400,505 | A | 3/1995 | Wei et al. | |
| 5,562,245 | A * | 10/1996 | Berthelemy et al. | 228/190 |
| 7,726,023 | B2 * | 6/2010 | Pursell | 29/889.23 |

FOREIGN PATENT DOCUMENTS

| | | |
|---|---|---|
| DE | 43 35 557 | 2/1995 |
| EP | 0 997 549 | 5/2000 |
| GB | 2 280 909 | 2/1995 |

OTHER PUBLICATIONS

U.S. Appl. No. 12/810,751, filed Jun. 25, 2010, Masson, et al.
U.S. Appl. No. 12/810,949, filed Jun. 28, 2010, Masson, et al.
U.S. Appl. No. 13/002,514, filed Jan. 4, 2011, Dunleavy, et al.
U.S. Appl. No. 13/002,580, filed Jan. 4, 2011, Dunleavy, et al.

* cited by examiner

*Primary Examiner* — Roy King
*Assistant Examiner* — Ngoclan T Mai
(74) *Attorney, Agent, or Firm* — Oblon, Spivak, McClelland, Maier & Neustadt, L.L.P.

(57) ABSTRACT

The invention relates to a method for making a metal part that comprises a reinforcement (15) made of ceramic fibers. The method comprises the following steps: forming at least one annular-shaped insert (15) by assembling a bundle of metal-coated fibers; placing the insert into a hollow metal mold (10) such that the insert is spaced between the walls (10*a*, 10*b*) of the mold; filling the mold with a metal powder; generating vacuum in the mold and closing the same; hot isostatic compressing the assembly at a temperature and under a pressure sufficient for binding the powder particles between them and for binding the insert fibers between them; removing the mold and optionally machining to the desired shape.

10 Claims, 3 Drawing Sheets

METHOD FOR MAKING PARTS WITH AN INSERT MADE OF A METAL-MATRIX COMPOSITE MATERIAL

The present invention relates to a process for manufacturing a metal part having a reinforcement made of a metal-matrix composite of the type with ceramic fibers in a metal matrix.

In the aeronautical field in particular, it is endeavored to produce parts having optimum mechanical properties for as low a mass as possible. For this purpose, an insert made of a metal-matrix composite is incorporated into certain parts. This composite comprises ceramic fibers, for example silicon carbide fibers, embedded in a metal matrix, such as a titanium alloy. The ceramic fibers have the property of having a very high tensile strength and compressive strength, greater than those of the metal. The metal matrix provides the function of a binder for the part and of protecting and isolating the fibers.

A known process for manufacturing such parts with a reinforcement comprises the production of a winding of a coated filament around a mandrel. The winding is then incorporated into a main metal body or container in which a slot forming a housing has been machined beforehand. The depth of the slot is greater than the height of the winding. A cover is placed on the container and welded onto its periphery. The cover has a tenon of shape complementary to that of the slot, and its height is matched to that of the winding placed in the slot so as to fill the slot. A hot isostatic pressing step is then carried out, during which the winding is compacted by the tenon. The metal sheaths of the coated filaments become welded together and to the walls of the slot by diffusion in order to form a dense assembly composed of a metal alloy within which the ceramic fibers extend annularly. The part obtained is then machined to the desired shape.

For the purpose of simplifying the manufacture of such a part, and instead of manufacturing the insert separately and then transferring it to the slot in the main body, patent FR 2 886 290 in the name of SNECMA proposes to produce the winding directly on the main body. Instead of a slot, two shoulders are provided in the body. The first shoulder has a bearing surface for the direct winding of a coated filament. This surface is parallel to the winding direction. When the winding has been completed, the slot is reconstituted by placing a part on the main body, which is of shape complementary to that of a second shoulder forming a step relative to the first shoulder. The cover with the tenon is then placed on the insert that has just been wound and the assembly is then compacted.

The manufacturing techniques mentioned above involve precise machining of the housings and, after the part blank has been produced by compression of the insert and welding of the elements together, a machining operation to obtain the part. These operations thus involve not only machining a large amount of material but also machining operations that are tricky to perform. For these reasons, the manufacturing cost of this type of part is high, and it is desirable to reduce it as far as possible.

The object of the present invention is therefore to improve the manufacture of a part with a reinforcement of this type, so as to reduce the cost thereof.

The process according to the invention for manufacturing a metal part that includes a ceramic-fiber reinforcement comprises the following steps:

formation of an insert, by assembling metal-coated ceramic fibers;

preparation of a hollow metal mold, the internal volume of which corresponds to the envelope of the part to be produced;

incorporation of the insert into the metal mold in such a way that the insert is spaced away from the walls of the mold;

filling of the mold with a metal powder;

closure of the mold by a cover with creation of a vacuum in the enclosure and welding of the cover to the mold;

hot isostatic pressing of the assembly, at a temperature and a pressure that are sufficient for deforming the envelope of the mold, for compacting the powder and the fibers and for bonding the powder particles and the fibers; and removal of the mold and, where appropriate, machining to the desired shape.

By employing powder technology in a hot isostatic pressing operation, it is possible to produce, directly, parts having both a high dimensional precision, good mechanical performance and excellent metallurgical homogeneity. Furthermore, the geometry of the part resulting from the process may be chosen so that it is as close as possible to the definitive part, requiring no or few machining operations.

The process allows the use of one or more inserts of various shapes, depending on the shape of the part and the reinforcement desired. Each insert may thus be of annular shape. More particularly, it may be axisymmetric or else it may have at least one straight portion. When the insert is straight, in the form of a straight segment, it is preferably formed from coated filaments subjected together to a hot isostatic pressing treatment.

When at least two inserts are placed in the mold, they may be superposed. The arrangement depends on the structure of the part to be manufactured and on the expected mechanical properties.

To limit the machining operations on the blank obtained, projections are provided inside the mold that reduce the volume to be filled with the metal powder in the zones where the material will be removed by machining. These projections define cavities in said metal part between the zones reinforced by the ceramic fibers.

Patent EP 1 669 144 discloses the manufacture of a metal article, such as a hollow fan blade with an internal reinforcement, also by powder metallurgy. However, the process involves producing a preform and then forming this preform in order to produce the hollow article. Such a process is not suitable for implementing the invention.

Document GB 2 280 909 discloses the manufacture of a metal part that includes ceramic fiber reinforcements. The metal-coated fibers are wound onto a support. The assembly is covered with a foil and the whole assembly is subjected to a hot isostatic pressing operation. However, such a technique does not allow the manufacture of parts from a hollow mold in which a prefabricated insert has been placed. Neither do the two documents EP 997 549 and DE 4 335 557 disclose the formation of an insert from a plurality of fibers.

Other features and advantages of the invention will become apparent on reading the following description with reference to the appended drawings in which.

Figure 1:
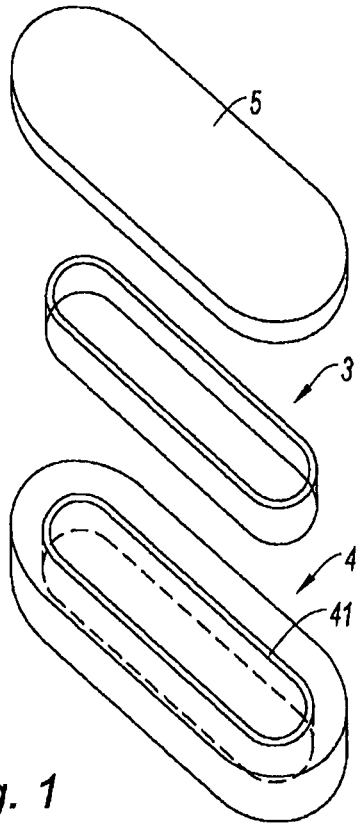
FIG. 1 shows a container of the prior art for producing a part of elongate shape with an insert made of a ceramic-matrix composite.

FIG. 1 shows a container 4 of the prior art, of elongate shape, for producing a part with an insert made of a metal-matrix composite. A slot 41 has been machined in the container so as to accommodate an insert 3. The slot and the insert are of complementary shape so that the insert is fitted into the slot without any clearance. A cover 5 then covers the assembly and has a protruding surface, not visible in the figure, so as to bear on the insert in the slot. A vacuum is created in the assembly and the cover is welded, for example by electron beam welding. The assembly is then placed in an appropriate enclosure in which it undergoes a hot isostatic pressing operation by subjecting it to a high pressure and a high temperature (1000 bar and 1000° C.). The techniques for manufacturing with an insert comprising at least one straight portion are described in patent applications FR 07/05453 and FR 07/05454 of Jul. 26, 2007 in the name of the Applicant.

The blank thus produced is then machined in order to obtain the desired shape. As shown in the above patent applications, parts having complex shapes, such as components for aircraft landing gear, may be obtained.

The solution of the invention allows such parts to be obtained more economically.

Firstly, a steel mold with a hollow shape close to that of the part to be manufactured is prepared.

Figure 2:
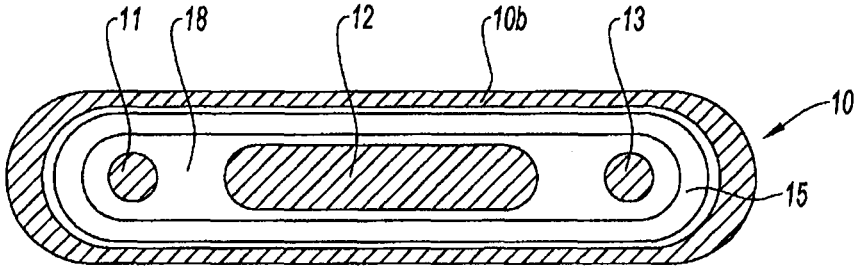
FIG. 2 shows, seen from above, a mold for the production of a part according to the invention, without its cover.
Figure 3:
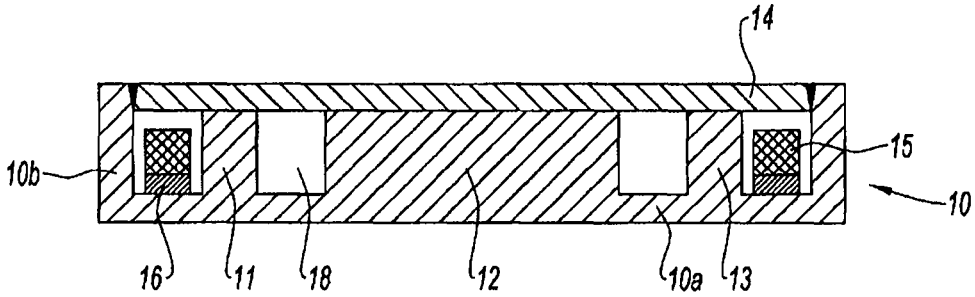
FIG. 3 shows, seen from the side and in longitudinal section, the mold of FIG. 2.
Figure 5:
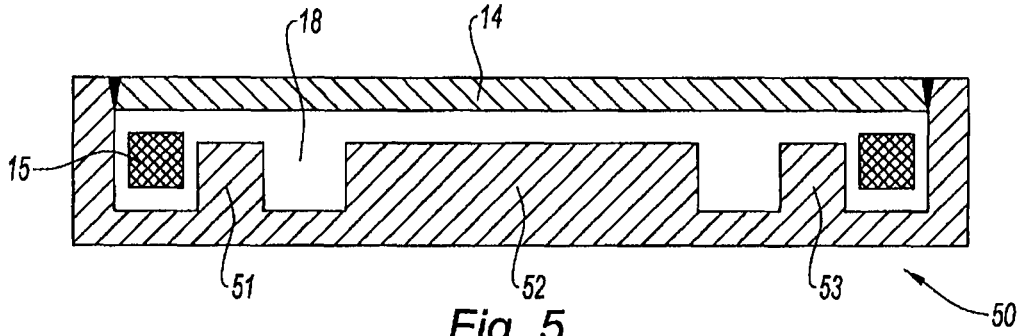
FIG. 5 shows, seen from the side and in longitudinal section, an embodiment of a mold for obtaining a part possessing more material.

FIGS. 2 and 3 show such a mold 10 for producing a part of generally elongate shape. This mold is hollow with a flat bottom 10*a* and a wall 10*b* of defined thickness and having a height corresponding to the thickness of the finished part. It includes projections 11, 12 and 13 inside the cavity. According to the example in this figure, the projections have a height that allows them to come into contact with a cover 14 that closes the mold. The height may however be lower, as shown in FIG. 5.

An insert 15 is placed in the mold. This insert comprises here two straight portions between two semi-circular portions. In the case of this type of insert, the straight portions may or may not be parallel and the semicircular portions may or may not have the same diameter.

The insert is produced, nonlimitingly, according to one of the methods taught by patent FR 2 886 290. This comprises the structure of the coated filaments, their manufacture, the manufacture of a bonded ply of coated filaments, the bonding of this ply either to the metal support on which it is wound, or to the ply of a lower layer, the welding of filaments by laser welding or by contact between two electrodes. If the insert includes at least one straight portion, it is more particularly produced using one of the methods given in patent applications FR 07/05453 or FR 07/05454 of Jul. 26, 2007 in the name of the Applicant. Thus, the insert may be obtained from a plurality of coated filaments each comprising a ceramic fiber coated with a metal sheath, with a step of winding it around an axisymmetric part, one portion of the winding taking place along a straight direction. If the insert forms a straight segment, it may be obtained from an insert blank with a straight portion which is compacted and then cut into straight segments.

The insert is positioned inside the cavity, being spaced away from the walls of the mold. One means for keeping the insert in the mold consists in placing it on a support 16 which, as the case may be, has a width corresponding to that of the insert over the entire length of the latter, or else on pins distributed beneath the insert. This support is preferably made of the same metal as that of the powder.

Figure 4:
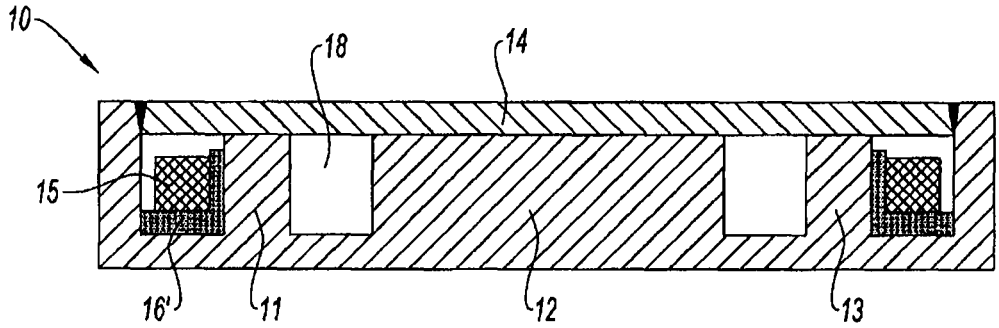
FIG. 4 shows, seen from the side and in longitudinal section, another method of supporting the insert in the mold.

In one embodiment, the support may consist of a part 16' having an L-shaped cross section, as shown in FIG. 4. In this case, the support is advantageously formed from the mandrel on which the coated filament was wound in order to constitute the insert, as described in the patent FR 2 886 920.

The mold is filled with metal powder 18. In this type of application, the metal may be a titanium alloy, such as the alloy TA6V, or a nickel alloy, such as Inconnel 625, or a stainless steel. The alloy used has a particle size distribution suitable for it to be used in powder metallurgy.

The powder may be introduced into the mold partly before the insert has been placed therein, where appropriate with the powder being precompacted. The mold is then filled.

The cover 14 is placed on the mold thus filled and a vacuum created in the cavity. The enclosure is then sealed by welding it.

The mold thus prepared is placed in a hot isostatic pressing enclosure. The enclosure thus makes it possible to keep the part at a temperature of 1000° C. and at a pressure of 1000 bar for several hours. Under these conditions, the mold is deformed owing to the reduction in volume by between 20 and 25% of both the insert and the powder.

After this operation, the powder is fully densified and no porosity remains. All the contacting portions are welded together by diffusion welding. The coated filaments are welded together forming a matrix within which the ceramic fibers are contained. The metal constituting the matrix of the insert is the same as that constituting the powder. However, the metal may be different therefrom.

The mold is then removed, either by selective dissolution using an acid, or mechanically. Where appropriate, the part is machined in order to obtain the desired shape.

This process makes it possible to vary the construction of the parts. In the above example, the projections extend over the entire height of the cavity of the mold. A minimum amount of material is used and a part 20, such as that shown in FIG. 9 with through-openings 21, 22 and 23, is obtained. The insert 15 integrated into the mass of metal is visible as if it were transparent.

Figure 9:
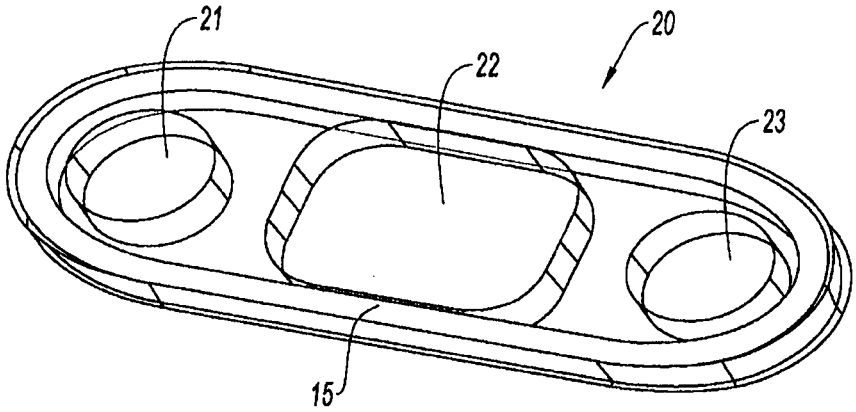
FIG. 9 shows the part obtained in a mold of the type of that in FIGS. 2, 3, 4 and 5, seen as if it were transparent.

FIG. 9 shows an example of a part which it is thus possible to produce by implementing the invention. The cost of obtaining it is about 30% lower than for a technique that involves machining after the hot pressing operation.

Figure 6:
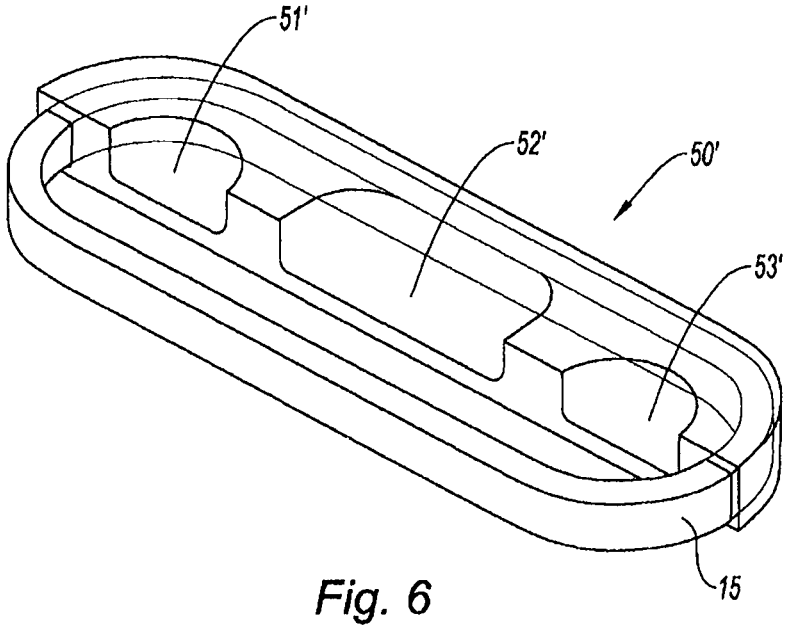
FIG. 6 shows the part obtained in a mold of the type shown in FIG. 5, seen as if it were transparent and with a cut-away portion.

In the example shown in FIG. 5, the projections 51, 52 and 53 of the mold 50 extend only partly over the height of the cavity of the mold. A part 50' is obtained with lightened portions 51', 52' and 53' but with no through-opening, as may be seen in FIG. 6. The insert is visible in the figure as if the part were transparent.

Figure 7:
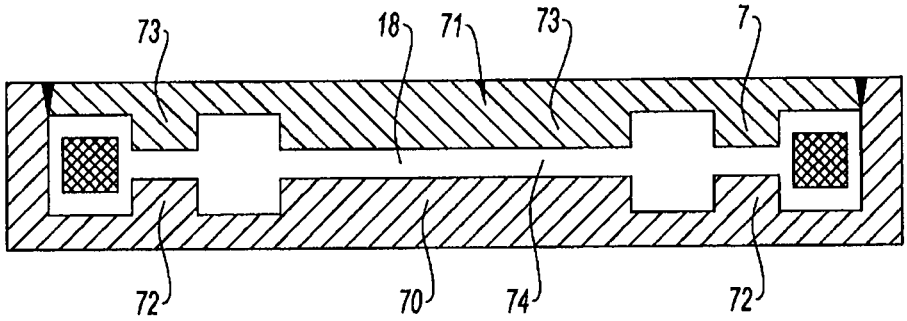
FIG. 7 shows, seen from the side and in longitudinal section, another embodiment of a mold for obtaining a symmetrical part.
Figure 8:
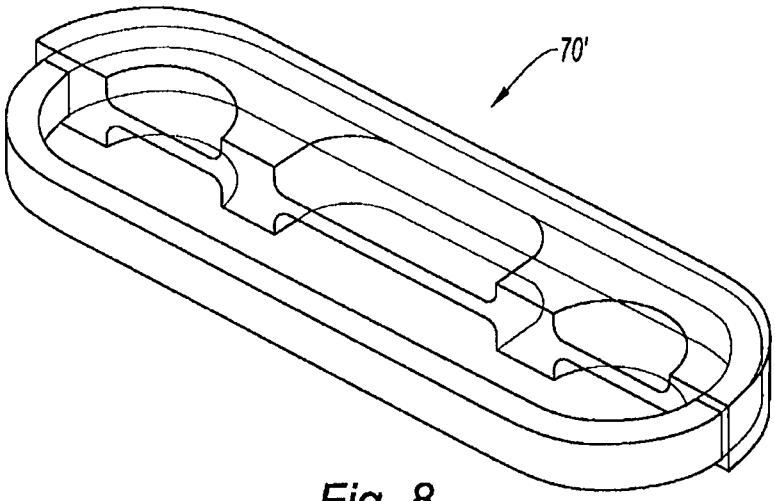
FIG. 8 shows the part obtained in a mold of the type shown in FIG. 7, seen as if it were transparent and with a cut-away portion.

In the example shown in FIG. 7, a mold 70 and its associated cover 71, which have protrusions 72, 73 symmetrical with respect to a central wall 74, are used. The molding 70' shown in FIG. 8 is symmetrical.

The invention claimed is:

1. A process for manufacturing a metal part that includes at least one ceramic-fiber reinforcement, comprising:

forming at least one insert, by assembling metal-coated ceramic fibers into a bundle;

incorporating the insert into a hollow metal mold in such a way that the insert is spaced away from the walls of the mold;

filling the mold with a metal powder;

creating a vacuum in the mold and closing the mold;

hot isostatic pressing of the assembly, at a temperature and a pressure that are sufficient to bond the metal powder particles and the metal-coated fibers of the insert; and removing the mold and, where appropriate, machining to the desired shape.

2. The process as claimed in claim 1, the insert wherein is of annular shape.

3. The process as claimed in claim 1, wherein the insert has at least one straight portion.

4. The process as claimed in claim 1, wherein the insert is straight and has been formed from coated filaments subjected together to an insert hot isostatic pressing treatment.

5. The process as claimed in claim 1, wherein the insert is placed in the mold by means of a support.

6. The process as claimed in claim 5, wherein the support is the mandrel for winding the insert.

7. The process as claimed in claim 1, wherein at least two inserts are placed in the mold.

8. The process as claimed in claim 7, wherein the two inserts are superposed.

9. The process as claimed in claim 1, wherein projections are provided in the mold, the projections defining cavities in said metal part between zones reinforced by the metal-coated ceramic fibers.

10. The process as claimed in claim 1, wherein the insert is of an axisymmetric shape.

* * * * *